US011133587B2

(12) United States Patent
Uesaka et al.

(10) Patent No.: US 11,133,587 B2
(45) Date of Patent: Sep. 28, 2021

(54) ANTENNA DEVICE AND ARRAY ANTENNA DEVICE

(71) Applicant: Mitsubishi Electric Corporation, Tokyo (JP)

(72) Inventors: Takashi Uesaka, Tokyo (JP); Satoshi Yamaguchi, Tokyo (JP); Naoyuki Yamamoto, Tokyo (JP); Toru Fukasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 106 days.

(21) Appl. No.: 16/634,851

(22) PCT Filed: Aug. 22, 2017

(86) PCT No.: PCT/JP2017/029862
§ 371 (c)(1),
(2) Date: Jan. 28, 2020

(87) PCT Pub. No.: WO2019/038819
PCT Pub. Date: Feb. 28, 2019

(65) Prior Publication Data

US 2020/0212593 A1 Jul. 2, 2020

(51) Int. Cl.
*H01Q 21/00* (2006.01)
*H01Q 3/44* (2006.01)
(Continued)

(52) U.S. Cl.
CPC ..... *H01Q 3/44* (2013.01); *H01Q 9/0407* (2013.01); *H01Q 21/065* (2013.01); *H01Q 3/24* (2013.01); *H01Q 21/00* (2013.01); *H01Q 21/064* (2013.01)

(58) Field of Classification Search
CPC ..... H01Q 3/44; H01Q 9/0407; H01Q 21/065; H01Q 21/064; H01Q 21/00; H01Q 3/24
See application file for complete search history.

(56) References Cited

U.S. PATENT DOCUMENTS

2004/0183735 A1 9/2004 Jecko et al.
2005/0200529 A1 9/2005 Watanabe
2008/0088510 A1* 4/2008 Murata ..... H01Q 19/28 343/700 MS

FOREIGN PATENT DOCUMENTS

JP 10-190347 A 7/1998
JP 11-31914 A 2/1999
(Continued)

OTHER PUBLICATIONS

International Search Report for PCT/JP2017/029862 (PCT/ISA/210) dated Oct. 17, 2017.
(Continued)

*Primary Examiner* — Joseph J Lauture
(74) *Attorney, Agent, or Firm* — Birch, Stewart, Kolasch & Birch, LLP

(57) ABSTRACT

An antenna device includes: a dielectric substrate 1; a first conductor 2 provided on a first surface of the dielectric substrate 1; a second conductor 100 provided on a second surface of the dielectric substrate 1, the second surface being opposite to the first surface on which the first conductor 2 is provided, the second conductor 100 having a feeding point 12; a third conductor 200*a* provided on the same second surface on which the second conductor 100 is provided; and a pair of transmission lines that electrically connect the second conductor 100 and the third conductor 200*a*.

6 Claims, 7 Drawing Sheets

(51) Int. Cl.

| | |
|---|---|
| ***H01Q 9/04*** | (2006.01) |
| ***H01Q 21/06*** | (2006.01) |
| *H01Q 3/24* | (2006.01) |

(56) References Cited

FOREIGN PATENT DOCUMENTS

| | | | |
|---|---|---|---|
| JP | 11-266113 | A | 9/1999 |
| JP | 2001-251128 | A | 9/2001 |
| JP | 2004-531153 | A | 10/2004 |
| JP | 2005-260592 | A | 9/2005 |
| JP | 2006-186851 | A | 7/2006 |
| JP | 3940955 | B2 | 7/2007 |
| JP | 2016-139965 | A | 8/2016 |

OTHER PUBLICATIONS

German Office Action dated May 7, 2021 in corresponding German Patent Application No. 11 2017 007 749.4 with an English Translation.

* cited by examiner

| | | State 1 | State 2 |
|---|---|---|---|
| PIN Diode Number | 23a, 23b | Conductive | Conductive |
| | 23c, 23d | Conductive | Nonconductive |
| | 23e, 23f | Conductive | Conductive |

ANTENNA DEVICE AND ARRAY ANTENNA DEVICE

TECHNICAL FIELD

The present invention relates to an antenna device and an array antenna device having variable directivity.

BACKGROUND ART

Antenna devices are required to have high gain in order to enable transmission and reception even with a weak radio wave. Wide coverage characteristics are also required to enable transmission and reception within a wide angle range.

As one of means for implementing high gain and wide coverage of an antenna, there are variable directivity antennas that provide directivity only in a specific direction while improving gain. The variable directivity antennas allow the antenna directivity to be variable by providing a parasitic element capable of changing the excitation coefficient around a feed antenna element. Moreover, by changing the excitation coefficient of the parasitic element, it is possible to switch radiation patterns having high gain in a desired direction to obtain high gain characteristics over a wide angle range.

For example, Patent Literature 1 discloses an antenna device using a switch, as a means for selecting a parasitic element having a desired excitation coefficient from among a plurality of parasitic elements having different excitation coefficients.

Meanwhile, Patent Literature 2 discloses an antenna device that changes the excitation coefficient of a parasitic element by changing the electrical length of the parasitic element.

CITATION LIST

Patent Literatures

Patent Literature 1: Japanese Patent No. 3940955
Patent Literature 2: JP 2006-186851 A

SUMMARY OF INVENTION

Technical Problem

In conventional inventions, a radiation pattern is formed in a desired direction by adjusting the size of the excitation amplitude and the phase which are caused to change by changing the size of a parasitic element and the distance from a feed element.

However, since the parasitic element is excited only by electromagnetic coupling with the feed element, the size of the excitation amplitude that the parasitic element can provide is limited. For this reason, there is a disadvantage that although a radiation pattern can be directed in a desired direction, the level of side lobes cannot be reduced if only by adjustment of the phase.

In addition, the element size and the distance between a feed element and a parasitic element which are parameters for determining the amplitude are difficult to design since they also affect the phase as well as the excitation amplitude. There is a disadvantage that it is difficult to form a desired radiation pattern, in the first place.

Solution to Problem

The present invention has been made to solve the above-described disadvantages, and provides an antenna device including: a dielectric substrate; a first conductor provided on a first surface of the dielectric substrate; a second conductor provided on a second surface of the dielectric substrate, the second surface being opposite to the first surface on which the first conductor is provided, the second conductor having a feeding point; a third conductor provided on the same second surface on which the second conductor is provided; and a pair of transmission lines that electrically connect the second conductor and the third conductor. The third conductor includes a slot provided in an area including a center point of the third conductor, at least one through-hole that electrically connects the third conductor and the first conductor and is disposed on a line segment connecting a center point of the second conductor and the center point of the third conductor, and a pair of switches that are connected to both respective sides in the slot in a direction perpendicular to the line segment connecting the center point of the second conductor and the center point of the third conductor, the pair of switches being provided at symmetrical positions with respect to the line segment connecting the center point of the second conductor and the center point of the third conductor.

Advantageous Effects of Invention

According to the present invention, the level of side lobes can be lowered by greatly changing the excitation amplitude, and therefore a more advanced radiation pattern can be formed.

DESCRIPTION OF EMBODIMENTS

First Embodiment

An array antenna device according to the present embodiment will be described with reference to FIGS. 1 to 5.

Figure 1:
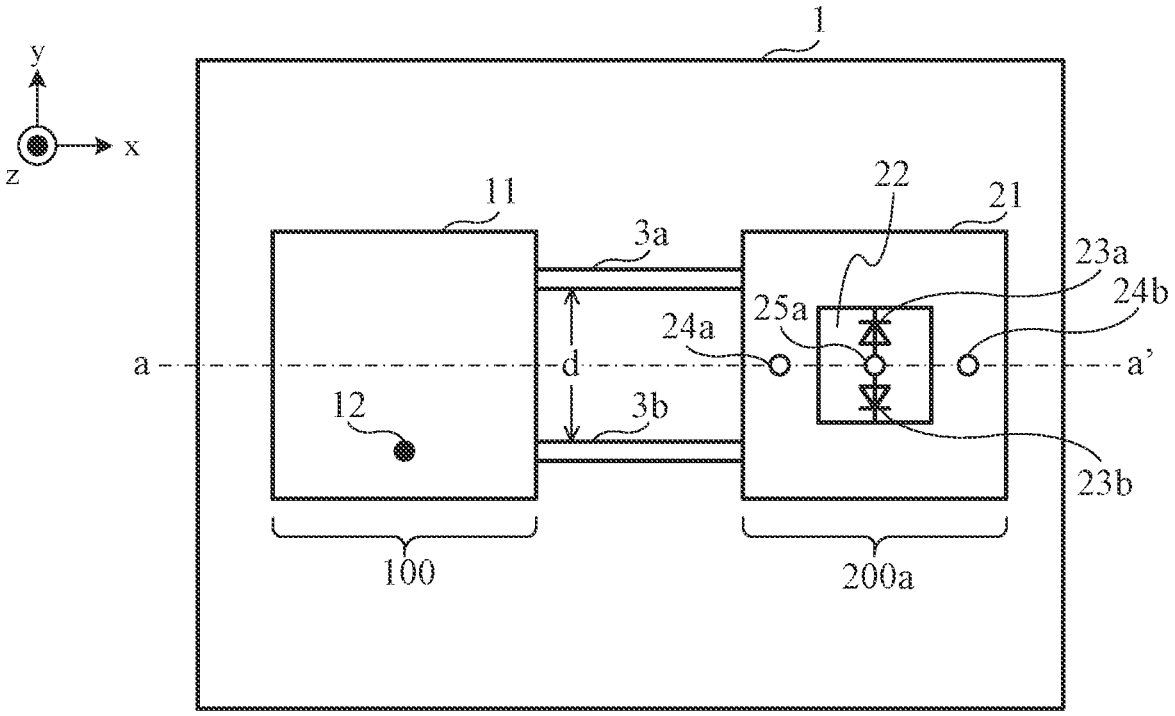
FIG. 1 is a plan view of an antenna device according to a first embodiment.
Figure 2:
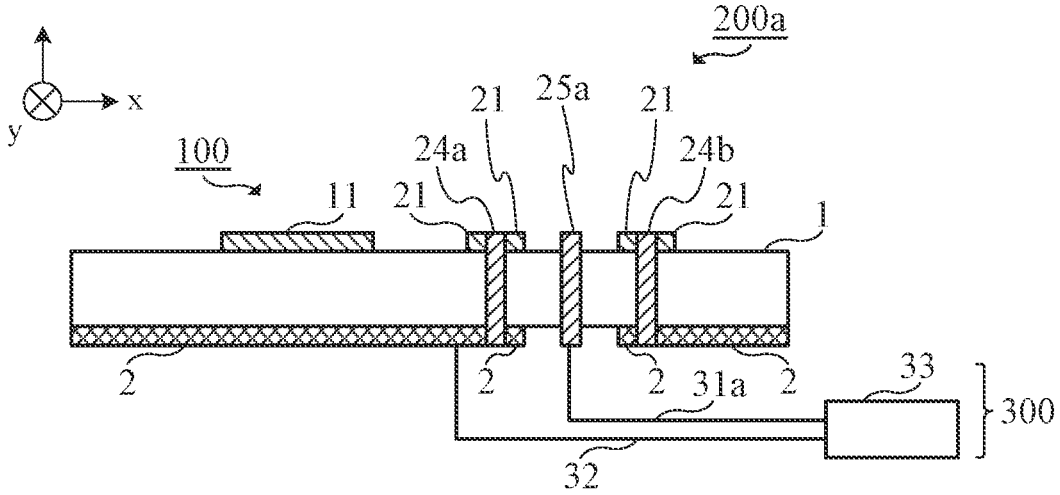
FIG. 2 is a cross-sectional view taken along a-a' of the antenna device according to the first embodiment.

FIG. 1 is a plan view of the antenna device according to the present embodiment, and FIG. 2 is a cross-sectional view of the antenna device according to the present embodiment.

In FIGS. 1 and 2, a symbol 1 denotes a dielectric substrate, 2 denotes a ground plate (first conductor) formed by providing a conductor on a lower surface (one surface) of the dielectric substrate 1, 100 denotes a feed element (second conductor) formed on an upper surface (opposite surface) of the dielectric substrate 1, 200*a* denotes a parasitic element (third conductor) formed on the upper surface of the dielectric substrate 1, 3*a* and 3*b* denote transmission lines formed on the upper surface of the dielectric substrate 1, 300 denotes a control device that supplies power to the parasitic element 200*a*, 31*a* denotes a control line, and 32 denotes a ground (GND) line.

Although the shape of the feed element 100 is a square in the present embodiment, any shape may be used as long as it is symmetrical with respect to an x-axis and a y-axis. That is, the feed element 100 may be, for example, a regular octagon, a regular dodecagon, or an ellipse other than a square or a rectangle.

Similarly, although the parasitic element 200*a* is also a square in the present embodiment, any shape may be used as long as it is symmetrical with respect to the x-axis and the y-axis.

Note that a line segment a-a' in FIG. 1 is parallel to the x-axis passing through the center points of the feed element 100 and the parasitic element 200*a*.

The antenna device according to the present embodiment includes the feed element 100 and the parasitic element 200*a* formed on the dielectric substrate 1, the transmission lines 3*a* and 3*b*, and the control device 300.

The feed element 100 includes a conductor element 11 and a feeding point 12.

The feeding point 12 is disposed at a position shifted from the center of the conductor element 11, and the position is determined from the polarization direction a desired radio wave and the input impedance. For example, in a case where the radio wave is polarized in the y-axis direction, the feeding point 12 is disposed at a position shifted from the center on the y-axis. The input impedance is 0 when the feeding point 12 is in the center of the conductor element 11, and is maximized when the feeding point 12 is at an end, and is disposed at a position where matching with the characteristic impedance of a feeding circuit can be achieved.

The size of the conductor element 11 is designed so that the frequency of a high frequency signal fed from the feeding point 12 achieves resonance.

The parasitic element 200*a* includes a square conductor element 21 and switches 23*a* and 23*b*. In the present embodiment, since the radiation direction is the x-axis direction, the parasitic element 200 is disposed in the +x-axis direction with respect to the feed element 100.

A slot 22 is formed by removing an area including the center point of the conductor element 21. Although an example is described in the present embodiment in which the slot 22 is formed by removing a part of the conductor element 21 in a rectangular shape, the shape of the slot 22 is not necessarily the same as the shape of the parasitic element 200*a* as long as the shape of the slot 22 is larger than through-holes and as long as the parasitic element 200*a* satisfies a desired excitation coefficient.

Through-holes 24*a* and 24*b* are arranged at positions on the line segment a-a' of the conductor element 21, and are connected to the GND line 32 via the ground plate 2.

The through-hole 25*a* is disposed on the line segment a-a' of the slot 22. Note that the conductor of the ground plate 2 around the through-hole 25*a* is removed to prevent conduction between the through-hole 25*a* and the ground plate 2, and the through-hole 25*a* is connected to the control line 31*a*.

The switch 23*a* and the switch 23*b* are connected between the through-hole 25*a* and the conductor element 21, and can be in a conductive or non-conductive state. Note that an example in which p-intrinsic-n (PIN) diodes are used as the switch 23*a* and the switch 23*b* will be described in this embodiment. Incidentally, the switch 23*a* and the switch 23*b* are collectively referred to as a pair of switches.

The switch 23*a* is connected between the through-hole 25*a* and the conductor element 21 on the +y direction side when viewed from the line segment a-a', and the switch 23*b* is connected between the through-hole 25*a* and the conductor element 21 on the −y direction side when viewed from the line segment a-a'.

The switch 23*a* is connected to the through-hole 25*a* on the anode side, and is connected, on the cathode side, to the conductor element 21 on the +y direction side when viewed from the line segment a-a'. Similarly, the switch 23*b* is connected to the through-hole 25*a* on the anode side, and is connected, on the cathode side, to the conductor element 21 on the −y direction side when viewed from the line segment a-a'.

The parasitic element 200*a* is designed to have a frequency higher than the resonance frequency of the feed element 100 when the switches 23*a* and 23*b* are conductive, and is designed to have a frequency sufficiently lower than the resonance frequency of the feed element 100 when the switches 23*a* and 23*b* are non-conductive and to have an excitation amplitude under the non-conduction of the switches 23*a* and 23*b* lower than that under the conduction of the switches 23*a* and 23*b*.

The transmission line 3*a* and the transmission line 3*b* connect the feed element 100 and the parasitic element 200*a* at positions symmetrical with respect to the line segment a-a'.

The control device 300 includes the control line 31*a*, the GND line 32, and a power source 33. The control line 31*a* is connected to the through-hole 25*a*, and the GND line 32 is connected to the ground plate 2. The control device 300 applies a forward bias voltage to the control line 31*a* to cause the switch 23*a* and the switch 23*b* to be conductive, and applies a reverse bias voltage or no voltage to cause the switch 23*a* and the switch 23*b* to be nonconductive.

Next, the operation will be described.

When a high frequency signal is fed from the feeding point 12, a plane including a line segment connecting the center point of the conductor element 11 and the feeding point 12 is the polarization plane of the antenna.

The parasitic element 200*a* is excited by electromagnetic coupling generated by the high frequency signal flowing through the feed element 100, and is also excited by the high frequency signal flowing through the feed element 100 and directly flowing into via the transmission lines 3*a* and 3*b*.

Here, when the control device 300 causes the switch 23*a* and the switch 23*b* to be conductive and applies a forward bias voltage, the parasitic element 200*a* operates as a wave director since the parasitic element 200*a* is designed to have a resonance frequency higher than that of the feed element 100.

Next, the effect of the present embodiment will be described with reference to FIGS. 3 to 5.

Figure 3:
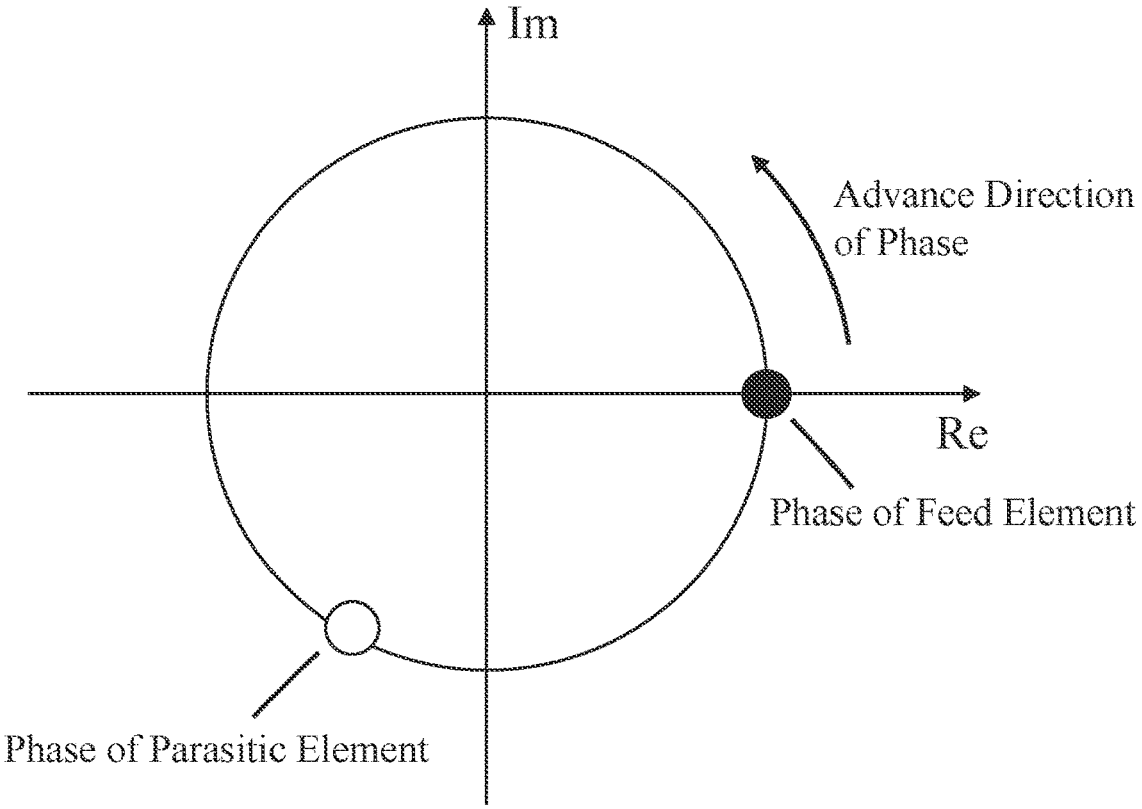
FIG. 3 is a diagram illustrating the excitation phase relationship between a feed element and a parasitic element according to the first embodiment.

FIG. 3 is a graph illustrating the phase relationship between the feed element 100 and the parasitic element 200*a* when a forward bias voltage is applied so that the switch 23*a* and the switch 23*b* are conductive.

As illustrated in FIG. 3, the phase of the parasitic element 200*a* is delayed with respect to that of the feed element 100, and thus it is made possible to obtain a radiation pattern having high gain in the +x direction in which radio waves radiated by the feed element 100 and the parasitic element 200*a* are in-phase.

Furthermore, the resonance frequency of the parasitic element 200*a* is lower than that of the high frequency signal when the control device 300 causes the switches 23*a* and 23*b* to be non-conductive, and thus the excitation amplitude is weak and the radiation pattern is less affected. Therefore, the radiation from the feed element 100 provides a high gain pattern forward. That is, an antenna having variable directivity can be obtained.

Figure 4:
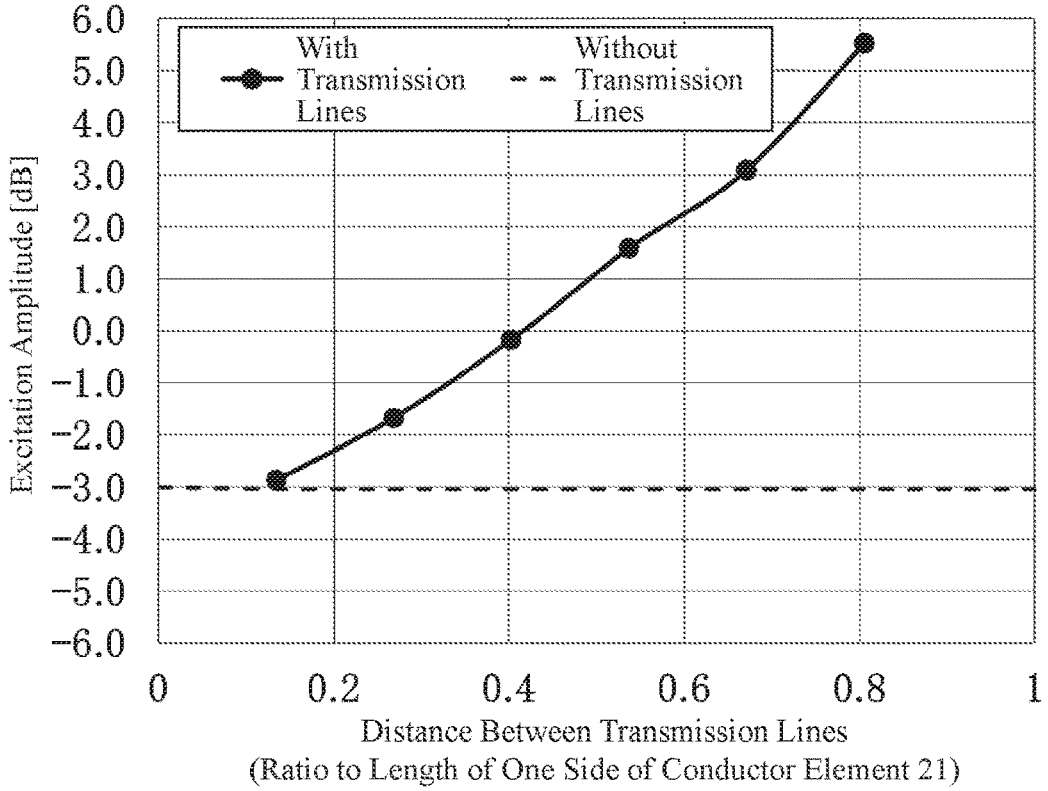
FIG. 4 is a diagram illustrating the excitation amplitude of the parasitic element with reference to the feed element according to the first embodiment.

FIG. 4 is a graph illustrating the excitation amplitude of the parasitic element 200*a* with the feed element 100 used as a reference. In the present invention, since the parasitic element 200*a* is excited via the transmission lines 3*a* and 3*b*, a large excitation amplitude can be obtained as compared with the case of using only electromagnetic coupling as illustrated in FIG. 4. Moreover, because the electric field of the feed element 100 increases as the distance from the line segment a-a' increases in the y-axis direction, the excitation amplitude of the parasitic element 200*a* can be increased by increasing the distance d between the transmission lines 3*a* and 3*b*. Moreover, the excitation amplitude of the parasitic element 200*a* can be reduced by reducing the distance d. In this manner, a designer can easily design the excitation amplitude of the parasitic element.

Figure 5:
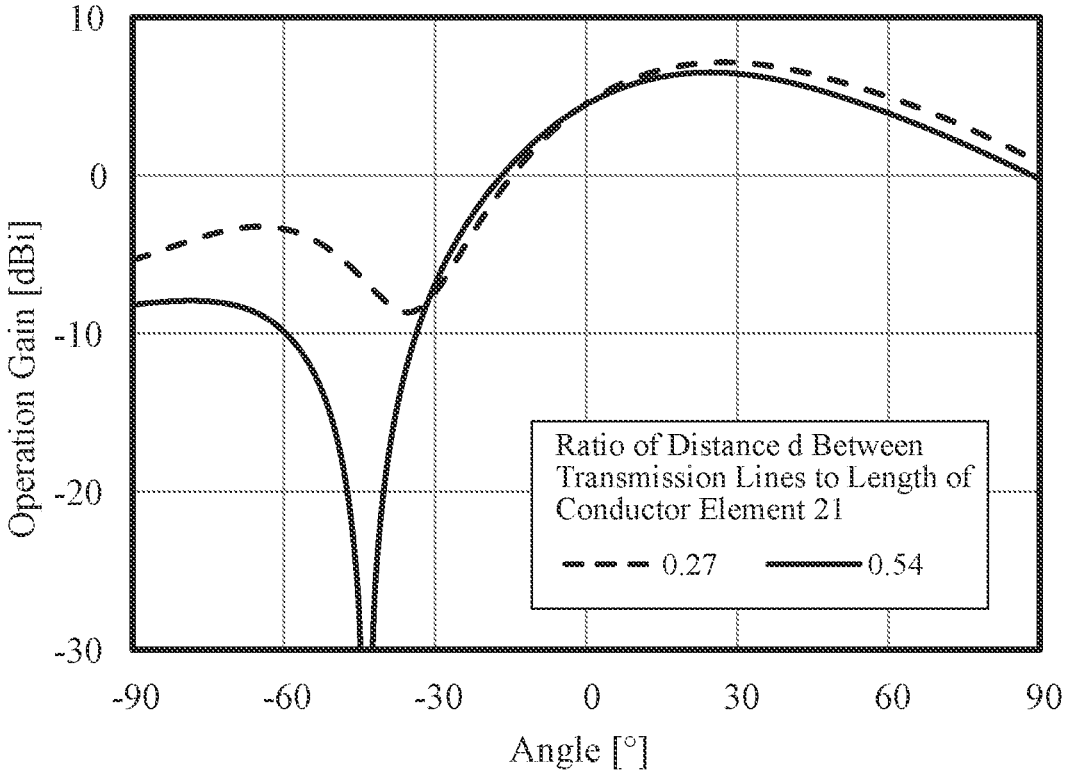
FIG. 5 is a diagram illustrating a zx-plane radiation pattern when switches according to the first embodiment are conductive.

FIG. 5 is a graph illustrating a radiation pattern when the distance d between the transmission lines 3*a* and 3*b* is caused to change. In the example of FIG. 5, cases in which the ratio of the distance d between the transmission lines 3*a* and 3*b* to the length of the conductor element 21 is 0.27 and 0.54 are illustrated, and a comparison between them shows that side lobes are kept lower in the case of 0.54.

It can be seen that by changing the distance d between the transmission lines 3*a* and 3*b*, the excitation amplitude of the parasitic element 200*a* is changed and that, as a result, the shape of side lobes changes. In other words, not only the maximum gain direction but also by lowering the level of side lobes, an advanced radiation pattern can be designed.

Note that one parasitic element 200*a* is disposed in the +x-axis direction in the above configuration; however, a parasitic element may be arranged also in the −x-axis direction. In this case, a high gain pattern can be obtained also in the −x axis direction.

In addition, since the control line 31*a* and the GND line 32 are arranged on the opposite side to the feed element 100 and the parasitic element 200*a* with respect to the ground plate 2, coupling of a high frequency signal can be suppressed as compared with a case in which the control line is on the radio wave radiation side when viewed from the ground plate. In addition, even when the coupled high frequency signal is re-radiated from the control line 31*a* and the GND line 32, the influence on the antenna directivity can be eliminated.

Since the through-holes 24*a*, 24*b*, and 25*a* are arranged on the line segment a-a' of the parasitic element 200*a*, the electric field of the line segment a-a' being 0 when a high frequency signal is fed, it is possible to prevent the high frequency signal from flowing.

Note that the ground plate is the bottom layer in the first embodiment; however, a control line layer may be provided under the ground plate 2, and a shield layer may be provided under the control line layer. In this case, it is possible to completely eliminate radiation to the back, the radiation being generated when a slightly leaked high frequency signal passes through the control line 31*a* and the GND line 32.

Second Embodiment

In the first embodiment, the parasitic element 200*a* includes one set of switches. In the present embodiment, a case where three sets of switches are included in a parasitic element 200*a* will be described. Note that the three sets of switches can be controlled separately.

Figure 6:
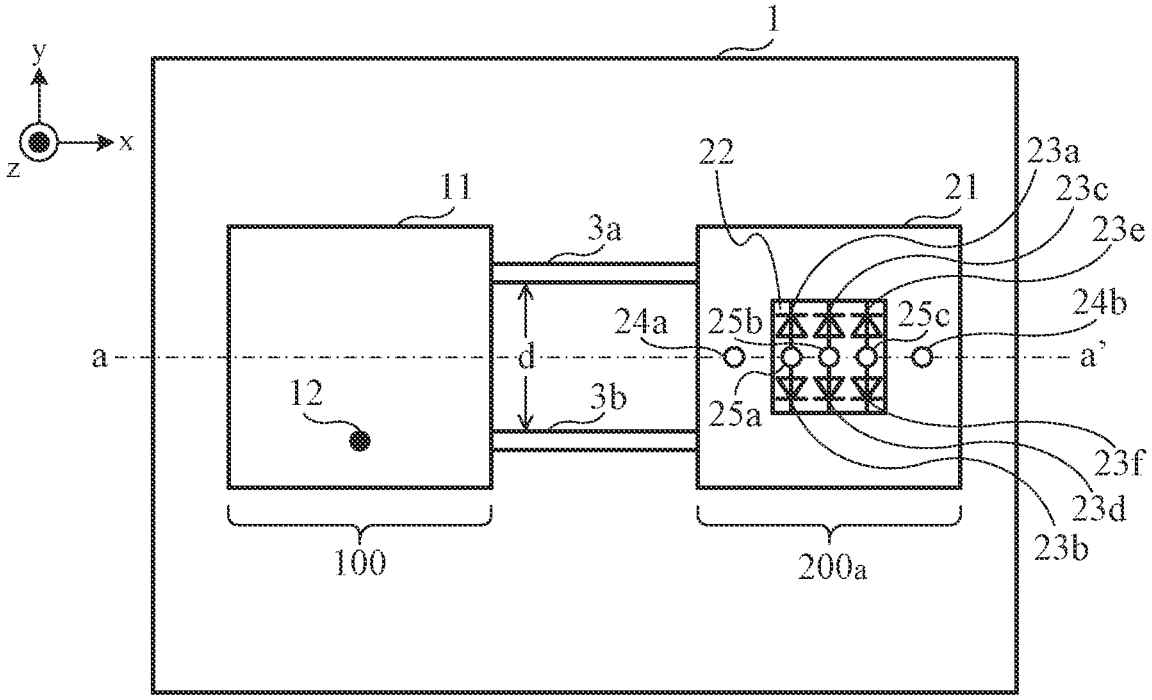
FIG. 6 is a plan view of an antenna device according to a second embodiment.
Figures 7, 8:
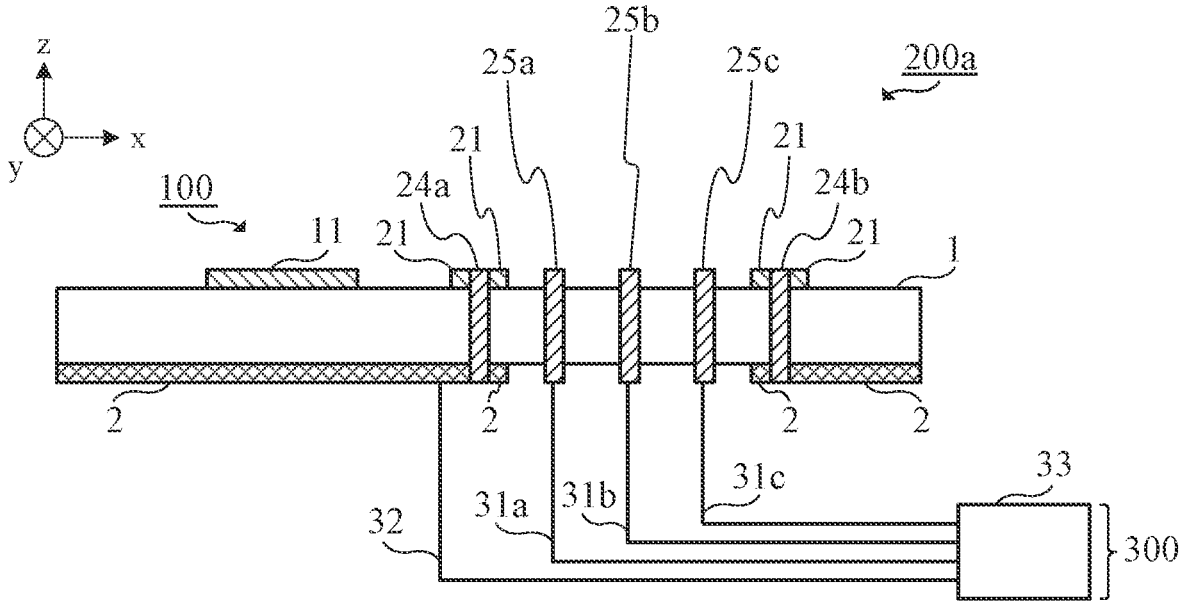
FIG. 7 is a cross-sectional view taken along a-a' of the antenna device according to the second embodiment.
FIG. 8 is a table illustrating an example of conductive/non-conductive states of switches according to the second embodiment.

FIGS. 6 and 7 are diagrams illustrating an antenna device according to the present embodiment. In FIGS. 6 and 7, the same symbols as those in FIGS. 1 and 2 denote the same or corresponding parts.

A feed element 100 and transmission lines 3*a* and 3*b* in FIGS. 6 and 7 have the same structure as in the first embodiment; however, the parasitic element 200*a* is partially different in structure.

In this embodiment, in addition to through-holes 24*a*, 24*b*, and 25*a* and switches 23*a* and 23*b*, through-holes 25*b* and 25*c* on a line segment a-a' of a slot 22 and the switches 23*c*, 23*d*, 23*e*, and 23*f* are newly added.

In addition, 31*b* denotes a control line connected to the through-hole 25*b*, and 31*c* denotes a control line connected to the through-hole 25*c*.

The switches 23*a* and 23*b* are connected to the through-hole 25*a*, the switches 23*c* and 23*d* are connected to the through-hole 25*b*, and the switches 23*e* and 23*f* are connected to the through-hole 25*c*, on their respective anode sides.

The cathode sides of the switches 23*a*, 23*c*, and 23*e* are connected to a conductor element 21 on the +y direction side when viewed from the line segment a-a', and the cathode sides of the switches 23*b*, 23*d*, and 23*f* are connected to the conductor element 21 on the −y direction side viewed from the line segment a-a'.

Next, the operation will be described.

The points that the parasitic element 200*a* is excited by electromagnetic coupling generated by a high frequency signal flowing through the feed element 100 when the high frequency signal is fed from the feeding point 12 and that, in addition to this, the parasitic element 200*a* is also excited by the high frequency signal flowing through the feed element 100 and directly flowing into via the transmission lines 3*a* and 3*b*, are the same as in the first embodiment.

In the present embodiment, it is possible to cause the resonance frequency of the parasitic element 200 to change and to cause the phase excited by the parasitic element to change, depending on conductive or non-conductive states of the switches 23*a*, 23*b*, 23*c*, 23*d*, 23*e*, and 23*f*.

Figure 9:
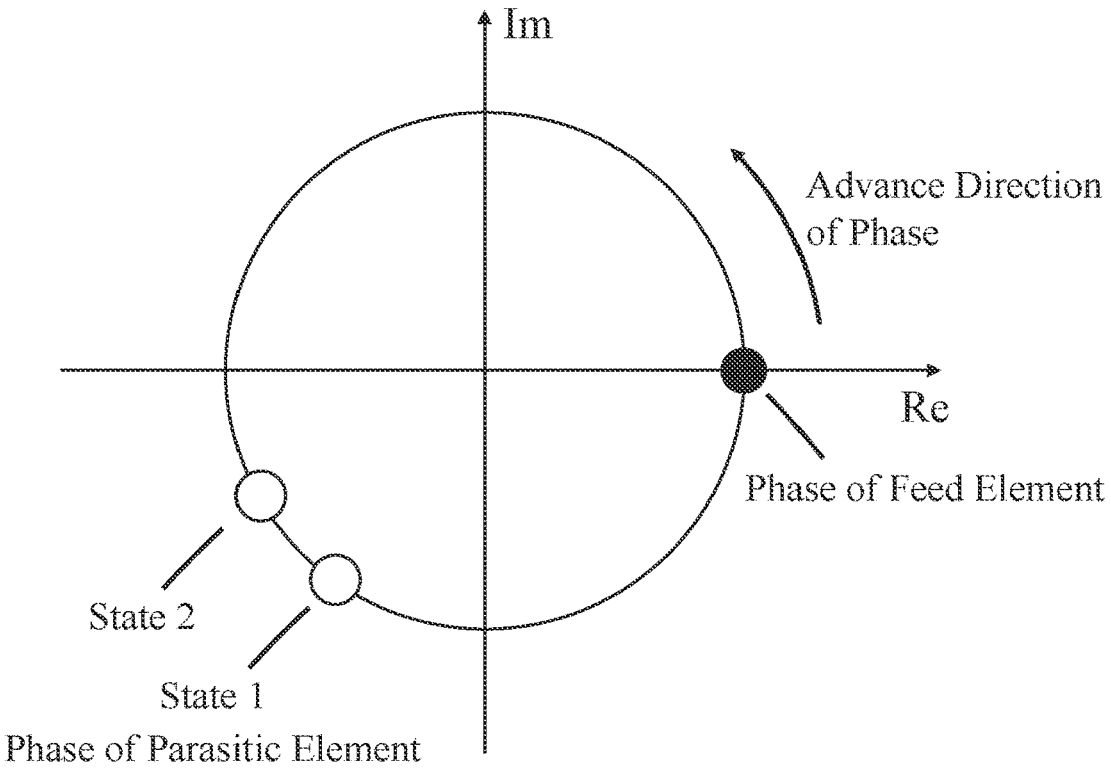
FIG. 9 is a diagram illustrating the excitation phase relationship between a feed element and a parasitic element according to the second embodiment.

An example of conductive and non-conductive states of the switches are illustrated in FIG. 8, and an excitation phase relationship between the feed element 100 and the parasitic element 200*a* is illustrated in FIG. 9.

Note that in FIG. 8, state 1 represents a case where all of the switches 23*a*, 23*b*, 23*c*, 23*d*, 23*e*, and 23*f* are conductive, and state 2 represents a case where the switches 23*a* and 23*b* are conductive, the switches 23*c* and 23*d* are non-conductive, and the switches 23*e* and 23*f* are conductive.

As illustrated in FIG. 9, in any of the states 1 and 2, the parasitic element 200*a* has a higher resonance frequency than that of the feed element 100, and thus operates as a wave director.

Since all the switches 23*a*, 23*b*, 23*c*, 23*d*, 23*e*, and 23*f* are conductive in state 1, the current flows through the conductor element 21 and all the switches 23*a*, 23*b*, 23*c*, 23*d*, 23*e*, and 23*f* without bypassing.

Since the switches 23*c* and 23*d* are non-conductive in state 2, the current bypasses the switches 23*c* and 23*d*, and the current flows through the conductor element 21 and the switches 23*a*, 23*b*, 23*e*, and 23*f*

Comparing the resonance frequencies of state 1 and state 2, state 2 has a lower resonance frequency than that of state 1 due to bypassing of the current, and as a result, state 2 has an excitation phase delayed with respect to that of state 1. As a result, two types of excitation phase patterns can be implemented.

As described above, in the present embodiment, by including three sets of switches in the slot of the parasitic element, different excitation phases can be implemented by the single parasitic element, and the maximum gain angle of the radiation pattern can be changed variously.

Note that although the case where a PIN diode is used as each of the switches for the parasitic element has been described in the first embodiment and the present embodiment, a variable capacitance diode may be used instead of the PIN diode.

When the value of the capacitance of the variable capacitance diode is caused to change, the resonance frequency of the parasitic element changes stepwise, and as a result, the excitation phase also changes.

Therefore, the maximum gain angle of the radiation pattern can be changed also by using a variable capacitance diode instead of the PIN diode.

Third Embodiment

In the first and second embodiments, the case where there is only one path of transmission lines has been described. In this embodiment, a case where there is a plurality of paths of transmission lines will be described.

Figure 10:
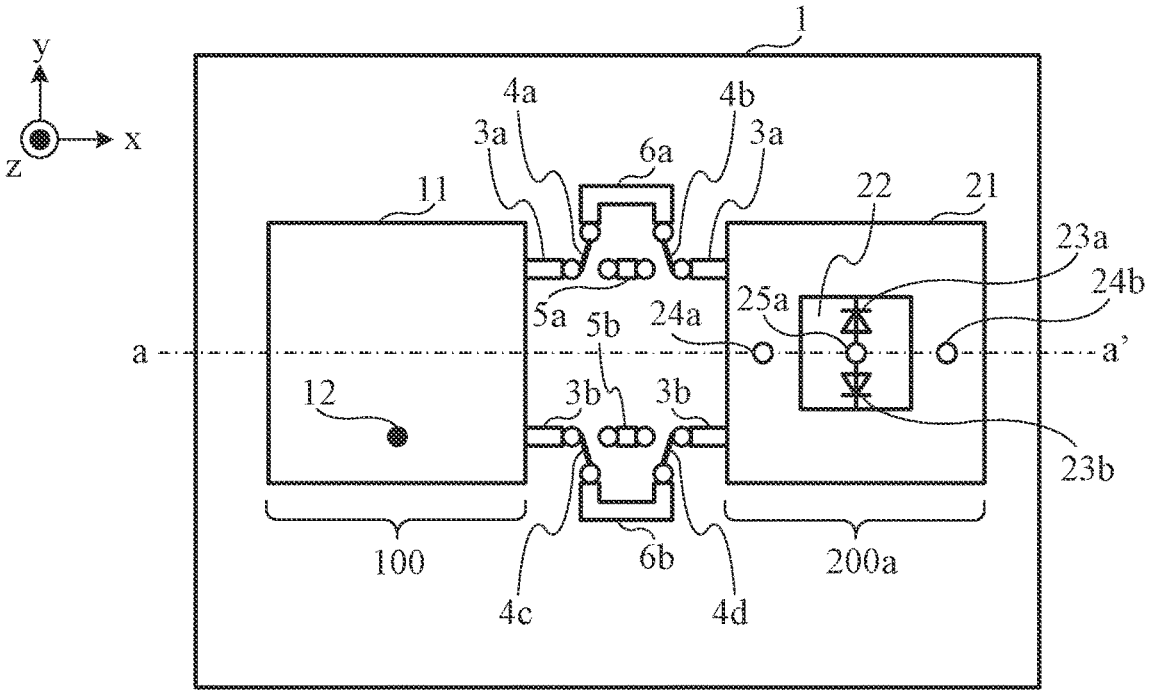
FIG. 10 is a plan view of an antenna device according to a third embodiment.

FIG. 10 is a plan view of the antenna device according to the present embodiment. In FIG. 10, the same symbols as those in FIG. 1 denote the same or corresponding parts.

The antenna device according to the present embodiment has the same basic configuration as that of the first embodiment, but differs in that there are two patterns of transmission lines.

In the present embodiment, as illustrated in FIG. 10, a transmission line 3*a* includes switchers 4*a* and 4*b* and transmission lines 5*a* and 6*a*, and a transmission line 3*b* includes switchers 4*c* and 4*d* and transmission lines 5*b* and 6*b*.

The switchers 4*a* and 4*b* are used to switch between the transmission line 5*a* and the transmission line 6*a* for connection. Likewise, the switchers 4*c* and 4*d* switch between the transmission line 5*b* and the transmission line 6*b* for connection. Note that the transmission lines 6*a* and 6*b* are longer than the transmission lines 5*a* and 5*b* in the present embodiment. The transmission lines 5*a* and 5*b* may have any shape as long as they have the same length, the same thickness, and the same shape. The same thing applies to the transmission lines 6*a* and 6*b*.

Next, the operation will be described.

A high frequency signal fed to the feed element 100 excites the parasitic element via electromagnetic coupling and the transmission lines. At this point, the transmission line 3*a* is connected to the transmission line 5*a* or the transmission line 6*a* by the switchers 4*a* and 4*b*, and the transmission line 3*b* is connected to the transmission line 5*b* or the transmission line 6*b* by the switchers 4*c* and 4*d*.

For example when the switchers 4*a*, 4*b*, 4*c*, and 4*d* are set so that the transmission lines 6*a* and 6*b* are connected, since the transmission lines 6*a* and 6*b* are longer than the transmission lines 5*a* and 5*b*, the excitation phase of the parasitic element 200*a* is delayed with respect to the case where the transmission lines 5*a* and 5*b* are connected. As a result, two types of excitation phase patterns can be implemented.

As described above, it is possible to change the excitation phase of the parasitic element by including a plurality of paths of transmission lines having different lengths and switching these paths. As a result, the maximum gain angle of the radiation pattern can be changed.

Fourth Embodiment

In the above embodiments, the antenna devices in each of which one parasitic element is disposed for one feed element have been described. In the present embodiment, a case where a plurality of parasitic elements is arranged for one feed element will be described.

Figure 11:
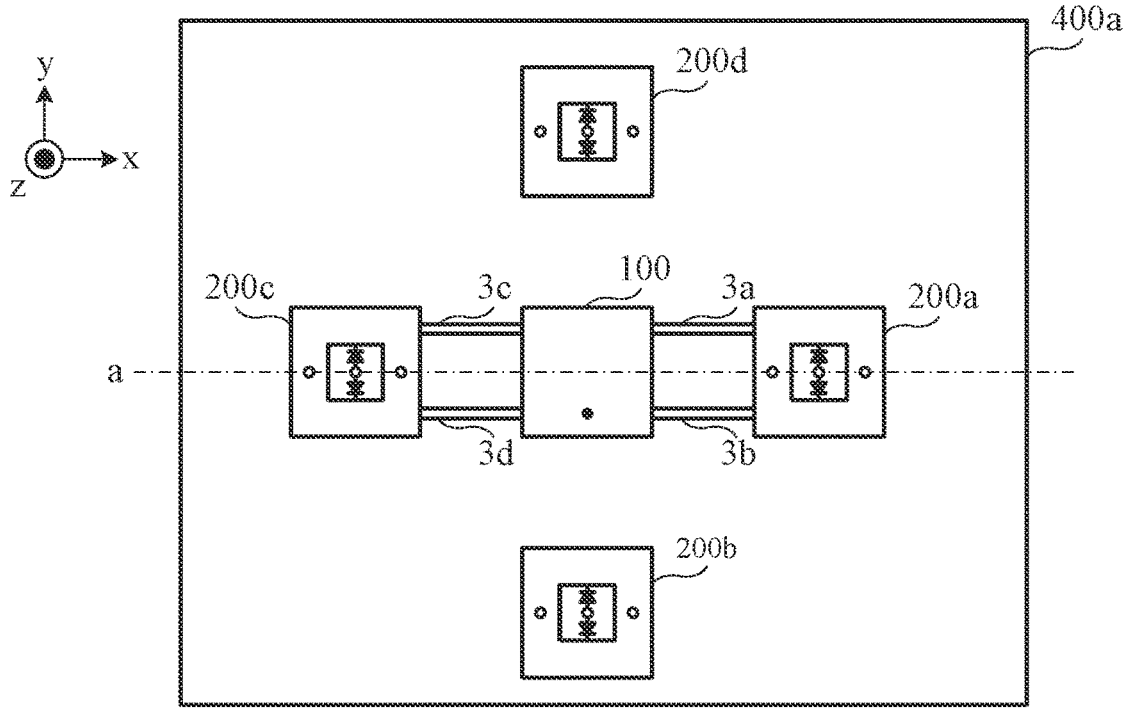
FIG. 11 is a plan view of an antenna device according to a fourth embodiment.

FIG. 11 is a plan view of an antenna device 400*a* according to the present embodiment. In FIG. 11, the same symbols as those in FIG. 1 denote the same or corresponding parts.

The antenna device according to the present embodiment has the same basic configuration as that of the first embodiment; however, a parasitic element 200*b*, a parasitic element 200*c*, and a parasitic element 200*d* are arranged around a feed element 100 in addition to a parasitic element 200*a*.

Another difference is that transmission lines 3*c* and 3*d* are provided between the feed element 100 and the parasitic element 200*c* and thereby the feed element 100 and the parasitic element 200*c* are connected. Note that the parasitic element 200*b*, the parasitic element 200*c*, and the parasitic element 200*d* have the same structure as that of the parasitic element 200*a* described in the first embodiment.

The parasitic element 200*b* is disposed at a position where the center of the parasitic element 200*b* is moved in the −y-axis direction from the center of the feed element 100. The distance between the center of the parasitic element 200*b* and the center of the feed element 100 is the same as the distance between the center of the parasitic element 200*a* and the center of the feed element 100.

The parasitic element 200*c* is disposed in the −x-axis direction of the feed element 100 so that the center of the parasitic element 200*c* is on the line segment a-a'. The distance between the center of the parasitic element 200*c* and the center of the feed element 100 is the same as the distance between the center of the parasitic element 200*a* and the center of the feed element 100.

The parasitic element 200*d* is disposed at a position where the center of the parasitic element 200*d* is moved in the +y-axis direction from the center of the feed element 100. The distance between the center of the parasitic element 200*d* and the center of the feed element 100 is the same as the distance between the center of the parasitic element 200*a* and the center of the feed element 100.

The parasitic elements 200*b* and 200*d* are arranged around the feed element 100, but are not physically connected to the feed element 100, and thus are excited only by electromagnetic coupling.

Next, the operation will be described.

When a high frequency signal is fed from a feeding point 12, the parasitic elements 200*a* and 200*c* are excited by electromagnetic coupling and via the transmission lines 3*a*, 3*b*, 3*c*, and 3*d*. On the other hand, the parasitic elements 200*b* and 200*d* are excited only by electromagnetic coupling.

Figure 12:
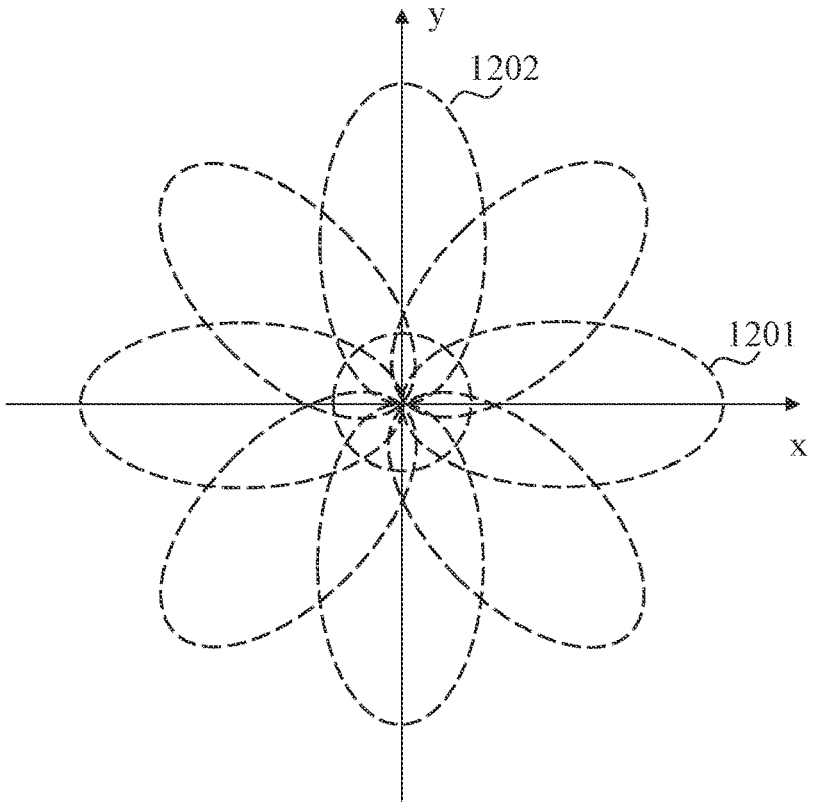
FIG. 12 is a conceptual diagram illustrating states of switches and beam directions.

FIG. 12 is a conceptual diagram according to the present embodiment, illustrating states of switches in the parasitic elements 200*a*, 200*b*, 200*c*, and 200*d* and beam directions depending on the states of the switches. When the control device 300 is operated, for example, to apply a forward bias voltage to switches included in the parasitic element 200*a* and to apply a reverse bias voltage or no voltage to switches included in the parasitic elements 200*b*, 200*c*, and 200*d*, the parasitic element 200*a* is excited with the large excitation amplitude as indicated by 1201 and with the phase delayed with respect to that of the feed element.

On the other hand, the excitation amplitudes of the parasitic elements 200*b*, 200*c*, and 200*d* are weak, and thus have little influence on the radiation pattern. At this point, the radiation pattern of the antenna device 400*a* has high gain in the +x-axis direction.

Meanwhile, when the control device 300 is operated to apply a forward bias voltage to the switches included in the parasitic element 200*d* and to apply a reverse bias voltage or no voltage to all the switches included in the parasitic elements 200*a*, 200*b*, and 200*c*, the radiation pattern of the antenna device 400*a* has high gain in the +y-axis direction as indicated by 1202.

As described above, in the present embodiment, by arranging a plurality of parasitic elements around the feed element 100, the maximum gain direction of the radiation pattern can be changed two-dimensionally.

Furthermore, by combining parasitic elements such as the parasitic elements 200*a* and 200*c* which provide a strong excitation amplitude by electrical connection with the feed element 100 via transmission lines, and parasitic elements without including transmission lines such as parasitic elements 200*b* and 200*d* which provide a weak excitation amplitude by excitation only by electromagnetic coupling, the excitation amplitude can be controlled in a wider range than in a case of using only the parasitic elements excited only by electromagnetic coupling. As a result, it is possible to two-dimensionally implement advanced pattern formation which has high gain in a specific direction while lowering a side lobe in a specific direction.

Fifth Embodiment

In the fourth embodiment, the example in which the single antenna device including the plurality of parasitic elements is disposed has been described. In this embodiment, a case where a plurality of the antenna devices is arranged to form an array antenna device will be described.

Figure 13:
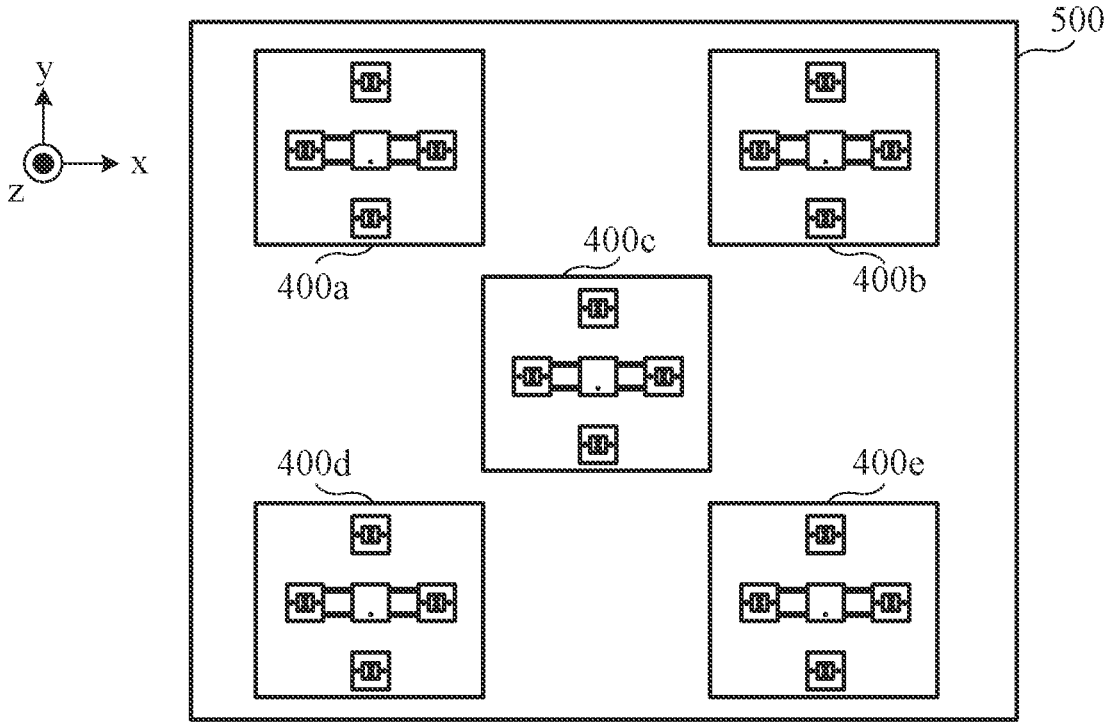
FIG. 13 is a plan view illustrating an array antenna device according to a fifth embodiment.

FIG. 13 is a plan view of the array antenna device according to the present embodiment. In FIG. 13, symbols 400*a*, 400*b*, 400*c*, 400*d*, and 400*e* denotes the antenna devices described in the fourth embodiment, and an array antenna includes the antenna devices 400*a*, 400*b*, 400*c*, 400*d*, and 400*e* arranged on a plane.

As described above, by arranging the plurality of antenna devices on a plane to form an array antenna, it is possible to obtain higher gain than in a case where there is one antenna device.

Note that although the arrangement in the present embodiment is a triangular array, the arrangement may be a linear array, a square array, an irregularly spaced array, or a three-dimensional array.

Furthermore, in a case where an active phased array antenna is configured by disposing a transmission and reception device including an amplifier, a phase shifter, etc. at a feeding point 12 of each element antenna, it is possible to scan with a beam by selecting setting phases of the phase shifters in such a manner that radiation phases of respective antenna devices is in-phase in a desired direction.

By changing the directivity of the antenna devices 400*a*, 400*b*, 400*c*, 400*d*, and 400*e* to a radiation pattern with high gain in a desired direction in conjunction with this beam scanning direction, the radiation pattern of the array antenna device can have higher gain than in the related art.

Furthermore, by allowing the radiation patterns of the antenna devices 400*a*, 400*b*, 400*c*, 400*d*, and 400*e* to have low gain in a specific direction, a side lobe in the specific direction can also be lowered in the radiation pattern of the array antenna device.

REFERENCE SIGNS LIST

1: Dielectric substrate, 2: Ground plate, 3*a*, 3*b*, 3*c*, 3*d*, 5*a*, 5*b*, 6*a*, 6*b*: Transmission line, 4*a*, 4*b*, 4*c*, 4*d*: Switcher, 11, 21: Conductor element, 12: Feeding point, 22: Slot, 23*a*, 23*b*, 23*c*, 23*d*, 23*e*, 23*f*: Switch, 24*a*, 24*b*, 25*a*, 25*b*, 25*c*: Through-hole, 31*a*, 31*b*, 31*c*: Control line, 32: GND line, 33: Power supply, 100: Feed element, 200*a*, 200*b*, 200*c*, 200*d*: Parasitic element, 300: Control device, 400*a*, 400*b*, 400*c*, 400*d*, 400*e*: Antenna device.

The invention claimed is:

1. An antenna device comprising:

a dielectric substrate;

a first conductor provided on a first surface of the dielectric substrate;

a second conductor provided on a second surface of the dielectric substrate, the second surface being opposite to the first surface on which the first conductor is provided, the second conductor having a feeding point;

a third conductor provided on the same second surface on which the second conductor is provided; and a pair of transmission lines that electrically connect the second conductor and the third conductor, wherein the third conductor includes a slot provided in an area including a center point of the third conductor, at least one through-hole that electrically connects the third conductor and the first conductor and is disposed on a line segment connecting a center point of the second conductor and the center point of the third conductor, and a pair of switches that are connected to both respective sides in the slot in a direction perpendicular to the line segment connecting the center point of the second conductor and the center point of the third conductor, the pair of switches being provided at symmetrical positions with respect to the line segment connecting the center point of the second conductor and the center point of the third conductor.

2. The antenna device according to claim 1, comprising a plurality of the pairs of switches.

3. The antenna device according to claim 1, wherein the pair of transmission lines is provided at symmetrical positions with respect to the line segment connecting the center point of the second conductor and the center point of the third conductor.

4. The antenna device according to claim 1, comprising:

a plurality of the pairs of transmission lines; and a switcher to switch to a desired pair of transmission lines among the plurality of pairs of transmission lines.

5. The antenna device according to claim 1, comprising a plurality of the third conductors.

6. An array antenna device comprising a plurality of the antenna devices according to claim 1, the plurality of antenna devices being arranged on a plane.

* * * * *